US005747163A

United States Patent [19]

Douglas

[11] Patent Number: 5,747,163

[45] Date of Patent: May 5, 1998

[54] POWDER FOR USE IN THERMAL SPRAYING

[76] Inventor: Richard M. Douglas, 116 Coral Bay Dr., League City, Tex. 77573

[21] Appl. No.: 764,421

[22] Filed: Dec. 12, 1996

Related U.S. Application Data

[63] Continuation of Ser. No. 559,927, Nov. 17, 1995, abandoned, which is a continuation of Ser. No. 116,874, Sep. 3, 1993, abandoned.

[51] Int. Cl.[6] ..... C23C 4/04; C23C 4/06

[52] U.S. Cl. ..... 428/404; 428/403

[58] Field of Search ..... 428/548, 551, 428/556, 558, 559, 565, 570, 904, 8, 403, 404; 75/252, 953; 419/35, 28

[56] References Cited

U.S. PATENT DOCUMENTS

| | | | |
|---|---|---|---|
| 3,655,425 | 4/1972 | Longo et al. | 117/100 M |
| 4,374,173 | 2/1983 | Adamovic | 428/325 |
| 4,508,788 | 4/1985 | Cheney | 428/570 |
| 4,578,114 | 3/1986 | Rangaswamy et al. | 75/252 |
| 4,578,115 | 3/1986 | Harrington et al. | 75/255 |
| 4,606,948 | 8/1986 | Hijrmrle et al. | 427/423 |
| 4,725,508 | 2/1988 | Rangaswamy et al. | 428/570 |
| 5,137,422 | 8/1992 | Price et al. | 415/200 |
| 5,328,763 | 7/1994 | Terry | 428/559 |
| 5,385,789 | 1/1995 | Rangaswamy et al. | 428/570 |
| 5,419,976 | 5/1995 | Dulin | 428/570 |
| 5,458,460 | 10/1995 | Okada et al. | 415/229 |

*Primary Examiner*—Daniel J. Jenkins
*Attorney, Agent, or Firm*—Robert J. Feltovic

[57] ABSTRACT

A powder for use in a thermal spraying coating process comprises particles consisting essentially of a metal carbide core coated at least partially with a layer consisting essentially of a nickel-chromium alloy containing the metal carbide dissolved therein. The particles are formed by heating a mixture of fine starting particles of the metal carbide in the presence of the nickel-chromium alloy under conditions effective to cause a portion, preferably 60 to 90 wt. %, of the starting metal carbide to dissolve in the Ni—Cr alloy. In an alternate embodiment suitable for higher temperature application, more than 90 wt. % of the starting carbide particles are dissolved. As the amount dissolved approaches 100 wt. %, the core essentially disappears. Coatings formed according to the invention show an unexpectedly large increase in both smoothness and erosion resistance.

14 Claims, No Drawings

POWDER FOR USE IN THERMAL SPRAYING

This application is a Continuation of prior U.S. application Ser. No. 08/559,927 Filing Date Nov. 11, 1995, now abandoned, which is a continuation of application Ser. No. 08/116,874 Filing Date: Sep. 3, 1993 now abandoned.

TECHNICAL FIELD

This application relates to a powder useful in thermal spraying of coatings, particularly for anti-corrosion coatings for metal parts.

BACKGROUND OF THE INVENTION

Chromium carbide coatings have been made by thermal spraying for many years. One such coating is made of $Cr_3C_2$ particles in a nickel-chromium alloy binder. Other carbides have also been used with nickel-chromium. However, for certain types of high temperature applications, chromium carbide is the only practical choice. For example, carbide in a cobalt binder can be used as an anti-erosion coating for many aircraft part surfaces, but lacks sufficient heat resistance for use in high temperature zones. Tungsten carbide titanium carbide solid solution with a nickel binder is somewhat better, but still inadequate at high temperatures.

During thermal spraying, the powder is heated, resulting in full or partial melting, and then sprayed onto the surface to be coated. The powder is generally a simple blend of chromium carbide powder with nickel chromium powder, most commonly a 75 wt. % chromium carbide/25 wt. % Ni—Cr mixture or 80 wt. % chromium carbide/20 wt. % Ni—Cr mixture, but blends ranging from 7 wt. t to 25 wt. % Ni—Cr are in common use. In general, during spraying the chromium carbide remains solid while the nickel-chromium alloy melts, resulting in a coating in which the carbide particles are embedded in nickel-chromium. If the carbide particles are relatively large, the resulting coating will have poor smoothness.

The nickel-chromium alloy used in these blends has been an 80 wt. % nickel/20 wt. % chromium alloy (e.g., NICHROME). The mixture is most commonly applied by a non-transferred plasma arc process. With the advent of the high velocity oxy-fuel (HVOF) spraying process, however, a need for new chromium carbide coating materials became apparent because the HVOF process does not work well with known chromium carbide/Ni—Cr alloy powder blends. The HVOF process tends to segregate the blend into its components, forming an unsatisfactory coating.

To overcome this problem, a prior art powder marketed by the assignee pre-blends 80 wt. % chromium carbide particles with 20 wt. % of the Ni—Cr (80:20) binder. The particles consists essentially of a chromium carbide core coated at least partially with a layer consisting essentially of a nickel-chromium alloy. Successive steps of sintering, grinding and classification are used to form the particles. Pre-blended particles prepared in this manner provided some improvement in performance, but the coating formed by HVOF spraying still had difficulty achieving both good smoothness and high erosion resistance properties.

The present invention provides an improved powder capable of producing coatings have much better erosion resistance properties in comparison to the foregoing known powder having a similar composition.

SUMMARY OF THE INVENTION

A powder for use in a thermal spraying coating process according to one aspect of the invention comprises particles consisting essentially of a metal carbide core coated at least partially with a layer consisting essentially of a nickel-chromium alloy containing the metal carbide dissolved therein. The particles are formed by heating a mixture of fine starting particles of the metal carbide in the presence of the nickel-chromium alloy under conditions effective to cause a portion, preferably 60 to 90 wt. %, of the starting metal carbide to dissolve in the Ni—Cr alloy. The amount of the original carbide particle that remains undissolved prior to spraying is difficult to estimate, but is generally from about 10 to 90 wt. % of that originally present, especially 10 to 40 wt. %, the precise amount depending on the smoothness of the coating desired and the spraying conditions.

The relative amounts of the carbide and the Ni—Cr alloy are selected so that, upon cooling of the sprayed coating, substantially all of the carbide remains in solution in the Ni—Cr alloy. If the amount of carbide is too great, carbide will precipitate out when the coating cools, forming a second phase that weakens the coating and lowers erosion resistance. Coatings formed according to the invention show an unexpectedly large increase in both smoothness and erosion resistance as compared to closely similar coatings, particularly coatings formed from the 80:20 chromium carbide/Ni—Cr alloy prior art powder described above, wherein the amount of carbide used was so great that a substantial portion of the carbide did not remain in solution.

According to a foregoing aspect of the invention, the carbide particles are not entirely pre-dissolved in the Ni—Cr alloy. If dissolution is complete, the resulting composite alloy has a higher overall melting point and may become more difficult to spray. Accordingly, it is preferred that only a portion of the metal carbide, preferably chromium carbide, be pre-dissolved in the Ni—Cr alloy. However, in accordance with an alternate embodiment of the invention suitable for plasma spraying, the powder may be prepared as set forth above except that more than 90 wt. %, up to and including 100 wt. %, of the starting carbide particles are dissolved. As the amount dissolved approaches 100 wt. %, the core essentially disappears.

DETAILED DESCRIPTION OF PREFERRED EMBODIMENTS

The powders of the invention can be referred to as alloyed, composite, or bonded metal carbides. Where the metal is chromium, these materials are formed by a process which creates particles containing both phases, namely a $Cr_3C_2$ core which has been covered by a complete or partial coating of the Ni—Cr binder alloy containing dissolved chromium carbide. Unlike prior spraying processes such as plasma spraying using a DC arc, or D-gun spraying, which operates by combustion of acetylene on a pulse basis, HVOF spraying operates in a continuous, high-velocity stream. The HVOF stream tends to separate the chromium carbide from the Ni—Cr alloy, resulting in isolated areas of each on the coating surface, or layering of one on the other, resulting in an inferior coating. It is difficult to melt and soften chromium carbide, so that very little is deposited.

The composite particles according to the invention can be applied without separation by HVOF spraying to surfaces such as aircraft parts made of hard metals such as steel or titanium alloys. A coating of the invention formed by HVOF spraying can have both low surface roughness and high resistance to erosion. Normally, increasing one of these characteristics decreases the other. For example, decreasing the particle size makes the resulting coating smoother, but the coating erodes more readily. In typical coatings formed using a finer powder, the resulting coating has higher stresses, rendering the particles more susceptible to oxidation and thereby increasing erosion.

Both erosion and surface roughness must meet prescribed specifications of aircraft manufacture or the coating will not be usable. For example, blades for use in stages 6 to 12 of a 12-stage rotary compressor for a 737 jet engine (CFM 56) must have a roughness of no more than about 80 Ra, particularly 30– 80 Ra, wherein Ra refers to the average difference in microinches between peaks and valleys in the coating. Erosion loss, as measured by sandblasting with 600 grams of fine white alumina, 230 grit, at 50–60 psi, should be 170 micrograms/gram or less, preferably 125 mg/g or less.

In making the powder of the invention, commercially available chromium carbide and Ni—Cr powders are transformed from a simple powder blend to a composite powder as described above. This may be accomplished by, for example, spray-drying chromium carbide particles with Ni—Cr. A preferred process combines the particles by solid-state sintering. During sintering, the outsides of the metal carbide particles dissolve in the surrounding Ni—Cr alloy. However, the sintering conditions are controlled as described below to prevent complete dissolution. The resulting alloy of the metal carbide and the Ni—Cr alloy deposited on the outsides of the metal carbide particles is a eutectic having a higher melting point than the starting Ni—Cr alloy. Upon thermal spraying, the remainder of the metal carbide melts, providing a coating with superior erosion resistance because it has no weak spots in the form of precipitated metal carbide or unmelted metal carbide particles. The coating made using such an alloy according to Example 1 below exhibited a single phase, an Ni—Cr—C alloy nearly free of carbide particles when examined under a microscope.

To prepare the powder of the invention, the particulate metal carbide is first blended with a nickel-chromium alloy to form a mixture. Regardless of the method of preparation, the use of fine starting metal carbide particles is important. If the starting carbide particles are too coarse, the desired solution does not form. If the starting carbide particles are too fine, the chrome carbide becomes pyrophoric and is difficult to handle. Chromium carbide particles from 1 to 10 microns in size have proven most effective.

The mixture of powders is sintered to form a solid mass, and preferably permitted to cool. The solid mass is then ground back into a powder form, and the powder is classified to obtain a powder the desired particle size distribution.

The mixture is preferably sintered at a temperature in the range of 1200° to 1500° C. for about 0.3 to 3 hours, most preferably 1250°to 1450° C. for about 30 to 90 minutes. Excessive heat or time (or both) causes large crystals to form which adversely affect the properties of the coating. On the other hand, insufficient sintering means the advantages of the invention are not obtained. The temperature of the mixture during sintering generally remains lower than the melting point of the two components, for example 1700°–1800° C. for chromium carbide and about 1400° C. for Ni—Cr (solution of Cr in Ni). Sintering may be carried out without external application of pressure.

The sintered and cooled mass, in the form of a fused ingot, is then returned to powder form by grinding. This is readily accomplished by one or more rough-crushing steps in which the ingot and large fragments thereof are broken up into a broad range of different-sized particles, and then a milling step in which coarse particles are further reduced in size to provide a fine particle mixture with particles ranging in size from about 1 to 100 microns.

The milled particles are then classified, preferably using a conventional air classifier, to obtain the desired particle size distribution. A broad range of particle sizes from about 2 to 100 microns can be used in thermal spraying, and classification may be omitted if grinding results in the desired particle distribution. For plasma spraying of the powder of the invention, particle sizes ranging from 44 to 100 microns are most preferred, in comparison to a range of 3 to 30 microns normally used for a chromium carbide powder/Ni—Cr alloy powder in plasma spraying.

As to HVOF spraying, in contrast to the mixtures of chromium carbide and Ni—Cr particles of the prior art used for compressor blade coatings, wherein the sizes range from about 10 to 40 microns with a mean of 25–30 microns, a range according to the invention of about 2 to 44 microns with a mean of around 9 to 13, especially 9–11 microns according to the invention results in a smoother coating which, surprisingly, has erosion resistance as good or better than the prior alloy with the much higher overall particle size. Sprayability is generally best at an intermediate size range of about 15–44 microns, and this range is preferred for applications wherein a high as-sprayed finish is not required. For example, valve components can be coated according to this embodiment of the invention and then ground and polished to obtain a higher finish.

For purposes of the invention, a "mean" refers to a particle size at which approximately half the particles have greater particle sizes and half have lesser sizes. Such a mean also closely approaches a weighted average particle size. "Particle size" for purposes of the invention refers to the diameter of a roughly spherical particle, or the largest dimension of a non-spherical particle.

The finished powder according to one embodiment of the invention useful in high temperature applications consists essentially of 4 to 7 wt. % Ni, 11 to 13 wt. % C, up to about 5 wt. % other elements (usually impurities) such as one or more of Fe, Mn, Si, W, Co, Mo and Zr, and the balance Cr (typically from 79 to 83 wt. %). Ranges of 4 to 6 wt. % Ni, 11.5 to 12.5 wt. % C, up to about 2.5 wt. % impurities are preferred to obtain optimum surface smoothness and erosion resistance. The 80:20 prior art powder described above contained about 16 wt. % Ni, 10.5 wt. % C, up to about 3 wt. % other elements and the balance Cr (about 70.5 wt. %).

The metal carbide used in the invention is most preferably chromium carbide or a mixture thereof with another metal carbide, or a carbide having comparable properties, such as titanium carbide. The Ni—Cr alloy used in the invention consists essentially of nickel and chromium but may contain substantial amounts of other elements. For example, the alloy used in Example 2 below contained 7 wt. % iron and 4 wt. % niobium, in addition to Ni and Cr. Niobium in an amount of from about 1 to 8 wt. % is a useful addition insofar as it inhibits grain growth in the coating.

The relative amounts of the starting powders and the amount of Cr in Ni are adjusted as needed to provide compositions wherein the metal carbide is partly dissolved in the Ni—Cr alloy prior to spraying, and the amount of carbide is such that it substantially completely dissolves in the Ni—Cr alloy upon thermal spraying and remains dissolved in the coating once cooled. These amounts will vary substantially depending on the carbide used and exact makeup of the Ni—Cr alloy; compare the results of Examples 1 and 2 below.

In a preferred embodiment wherein the metal carbide is chromium carbide and the Ni—Cr alloy is the one described above containing 4 to 7 wt. % Ni, 11 to 13 wt. % C, up to about 5 wt. % other elements, and the balance Cr, the amounts of starting chromium carbide and Ni—Cr alloy preferably vary from 92 to 85 wt. % $Cr_3C_2$ to 8 to 15 wt. % Ni—Cr. The relative amounts of Ni and Cr in the Ni—Cr alloy for this embodiment differ from the standard 80:20 NICHROME material. The weight ratio of Ni:Cr ranges from 70:30 to 50:50. In Example 1 below, a 50:50 Ni—Cr material was used in an amount of about 12 wt. % relative to 88 wt. % $Cr_3C_2$. Above 70 wt. % Ni, the amount of Cr in the alloy becomes insufficient to completely dissolve the carbide. At less than 50 wt. % Ni, formation of Ni—Cr ends and an undesirable second phase forms. However, if substantial amounts of other elements such as iron or niobium are present, the foregoing ranges will be different, as illustrated by Example 2 below.

The powder of this invention was developed for forming an erosion coating for an aircraft turbine. However, other useful applications include oil well valves and rig components, steam pipes and valves, and other components wherein surfaces are regularly exposed to a high temperature gas or liquid that can cause erosion. Some erosion applications, unlike air foil erosion coatings, will not need a fine finish, in which case larger particle sizes can be used.

The following examples illustrate the invention.

EXAMPLE

The starting materials consisted of chromium carbide ($Cr_3C_2$) powder and a nickel-chromium alloy powder. The specification of each was as follows:

Chromium Carbide

| | |
|---|---|
| Size | |
| <11 microns | 100% |
| Chemistry | |
| carbon | 12% min |
| silicon | 0.25 max |
| iron | 0.30 max |
| others | 1.0 max |
| chromium | balance |

Nickel-chromium alloy:

| | |
|---|---|
| Size | |
| <31 microns | 80% |
| Chemistry | |
| chromium | 49–50% |
| nickel | 49–50% |
| others | 1.0 max |

The raw materials were blended together at a ratio of 90 wt. % chromium carbide to 10 wt. % nickel-chromium alloy. The blend was placed in graphite saggers each painted with a calcium carbonate wash to prevent carbon pickup. The saggers were pushed through a moly-wound muffle furnace in a hydrogen-nitrogen atmosphere. The heat zone of the furnace was about 36 inches long, and each sagger moved through the heat zone in about one hour. The temperature at the center of the heat zone was maintained at 1300° C.±25° C.

Upon exiting the heat zone, the sagger entered a water jacketed cooling zone about 5 feet in length. The sagger and material were cooled to about 100° C. before exiting the furnace. Flame curtains were maintained at both the entrance and exit of the furnace to protect the product from oxidation. The product that emerged from the furnace was in the form of an ingot about 18 inches long, 3 inches wide, and 1–2 inches thick.

The ingots were then rough-crushed to pieces less than about 1 inch in size with a large jaw crusher. A smaller jaw crusher was then used to reduce the average particle size to less than about 0.25 inch. The crushed product was then fed into a high energy vibrating tube mill of a type effective to minimize iron contamination to reduce the particle size further. After milling, the powder was screened to −270 mesh, and the oversized material was returned to the mill for further crushing. The −270 material was air classified using a VORTEC C-1 Series Classifier to final product size. The exact size was selected based on the end use of the intended coated product, namely blades for use in stages 6 to 12 of a 12-stage rotary compressor for a 737 jet engine.

Six samples A–F according to the invention had compositions and approximate particle size distributions as set forth in Table 1 below. For the size distributions of part B, the values given for each sample represent the percentage of the total particles having particle sizes finer than the micron size in the left column. In part C, mv=mean value, and the values aligned with each percentage indicate a cutoff size at which the stated percent of the particles have that micron size or less.

TABLE 1

| Sample | A | B | C | D | E | F |
|---|---|---|---|---|---|---|
| A. Composition | | | | | | |
| Cr | 79.19 | 82.50 | 80.03 | 80.67 | 81.24 | 81.46 |
| N | 5.55 | 4.12 | 6.17 | 5.71 | 5.02 | 4.6 |
| Mn | 0.04 | 0.02 | 0.03 | 0.03 | 0.03 | 0.03 |
| Fe | 2.3 | 0.7 | 1.19 | 0.95 | 1.1 | 0.87 |
| Si | 0.01 | 0.01 | 0.08 | 0.12 | 0.07 | 0.05 |
| C | 12.31 | 11.76 | 11.69 | 12.02 | 12.02 | 12.43 |
| OT* | 0.6 | 0.89 | 0.81 | 0.5 | 0.52 | 0.56 |
| B. Size Distribution | | | | | | |
| Microns | | | | | | |
| 44 | 100 | 100 | 100 | 100 | 100 | 100 |
| 31 | 100 | 100 | 100 | 96.2 | 100 | 97.7 |
| 22 | 96.6 | 100 | 100 | 91.1 | 100 | 94.8 |
| 16 | 87.4 | 92.4 | 93.6 | 80.9 | 97.5 | 87.4 |
| 11 | 56.1 | 68 | 65.5 | 57.1 | 81.4 | 62.3 |
| 7.8 | 28.7 | 37.3 | 35.4 | 32.1 | 56.2 | 36 |
| 5.5 | 11.3 | 15.9 | 13.9 | 13.9 | 31.5 | 16.8 |
| 3.9 | 3.5 | 6.5 | 4.3 | 4.9 | 14.3 | 6.9 |
| 2.8 | 0.6 | 0.7 | 0.5 | 0.6 | 3 | 1.4 |
| C. Sie Distribution Summary | | | | | | |
| mv | 10.77 | 9.55 | 9.7 | 11.97 | 7.81 | 10.74 |
| 90% | 17.38 | 15.49 | 15.35 | 21.32 | 13.65 | 18.09 |
| 50% | 10.28 | 9.11 | 9.34 | 10.08 | 7.22 | 9.49 |
| 10% | 5.22 | 4.48 | 4.83 | 4.79 | 3.47 | 4.39 |

OT* refers to other elements. Samples A–F were applied by HVOF spraying using 160 psi oxygen, 100 psi hydrogen to stainless steel test pieces using a modified JET-KOTE sprayer from Stellite. The resulting coatings were tested for erosion by sandblasting with 600 grams of fine white alumina, 230 grit, at 50–60 psi.

The coatings made using Samples A–F according to the invention were tested for Rockwell 15N hardness (15N), diamond pyramid hardness or microhardness (DPH), erosion loss ($E_w$) as described above, and smoothness (Ra) in microinches. Desirable levels for aircraft coatings are a 15N hardness of at least 80, a microhardness of at least 750, erosion loss of less than 125 mg/g, and smoothness of less than about 80 Ra (microinches). Table 2 summarizes the results for the samples prepared using the powder of the invention:

TABLE 2

| Sample | Mean | 15N | DPH | $E_w$ | Ra |
|---|---|---|---|---|---|
| A | 10.77 | 90.9 | 816.8 | 109.3 | 76.1 |
| B | 9.55 | 91.2 | 876.7 | 10.4 | 74.9 |
| C | 9.70 | 90.8 | 831.5 | 109.9 | 73.8 |
| D | 1.97 | 91.2 | 839.7 | 108.1 | 80.2 |
| E | 7.81 | | | 107.3 | 59.9 |
| F | 10.74 | 91.0 | 828.7 | 104.2 | 74.8 |
| High | 10.77 | 91.2 | 876.8 | 10.4 | 76.1 |
| Low | 9.55 | 90.8 | 828.7 | 104.2 | 73.8 |
| Range | 1.22 | .4 | 48.1 | 6.2 | 2.3 |
| Average | 10.19 | 91.0 | 853.4 | 108.4 | 74.9 |

As these results indicate, the samples according to the invention had both excellent smoothness and erosion resistance. By comparison, the known 80:20 powder discussed above and variations thereon that were tested were comparable in most characteristics, but had smoothness values ranging from 75 to 90 Ra and erosion values ($E_w$) of about 125 to 148 mg/g. The large improvement in erosion resistance of the samples according to the invention is quite surprising in view of the comparatively small difference in the overall composition of the coatings.

EXAMPLE 2

Another powder according to the invention was prepared using substantially the same procedure as Example 1, except that the starting powder composition was 90 wt. % chromium carbide and 10 wt. % of an Ni—Cr alloy containing 20 wt. % Cr, 4 wt. % Nb, 7 wt. % Fe, traces of C and Mn, and 62.5 wt. % Ni. When HVOF sprayed and tested for erosion, the result was 117 micrograms/gram, with satisfactory smoothness suitable for high-temperature compressor blade applications. In this example, as in Example 1, the carbide was partly dissolved in the Ni—Cr alloy prior to spraying, and the amount of carbide was such that it substantially completely dissolved in the Ni—Cr alloy upon spraying and remained dissolved in the coating.

It will be understood that the foregoing description is of preferred exemplary embodiments of the invention, and that the invention is not limited to the specific forms shown. Modifications may be made in the composition and its method of preparation and use without departing from the scope of the invention as expressed in the appended claims.

I claim:

1. A powder for use in a thermal spraying coating process, comprising metal carbide particles consisting essentially of a chromium carbide core coated at least partially with a layer consisting essentially of a nickel-chromium alloy containing the metal carbide dissolved therein, wherein the particles have been formed by heating a mixture of fine starting particles of the metal carbide in the presence of the nickel-chromium alloy under conditions effective to cause from about 60 to 90 wt. % of the starting metal carbide to dissolve therein, and wherein the relative amounts of the carbide and the nickel-chromium alloy are selected so that, upon cooling of a thermally sprayed coating made from the powder, substantially all of the metal carbide remains in solution in the nickel-chromium alloy.

2. The powder of claim 1, wherein the fine particles of starting metal carbide have sizes in the range of from 1 to 10 microns.

3. The powder of claim 1, wherein the particles of the finished powder have particle sizes in the range of from about 2 to 44 microns, with an mean particle size of from about 9 to 13 microns.

4. The powder of claim 4, wherein the mean particle size is in the range of from 9 to 11 microns.

5. The powder of claim 2, wherein the powder has been formed by the steps of:

blending particulate chromium carbide with a particulate nickel-chromium alloy to form a mixture;

sintering the mixture to form a solid mass;

grinding the solid mass; and classifying the ground solid mass to obtain the powder.

6. The powder of claim 5, wherein the mixture is sintered at a temperature effective to cause solid state diffusion of the chromium carbide into the nickel-chromium alloy during formation of the solid mass, which mass thereby becomes a eutectic having a higher melting point than the starting nickel-chromium alloy.

7. The powder of claim 5, wherein the mixture is sintered at a temperature in the range of 1250 to 1450° C. for about 30 to 90 minutes.

8. The powder of claim 3, wherein the amounts of starting chromium carbide and nickel-chromium alloy are in the range of from 92 to 85 wt. % $Cr_3C_2$ to 8 to 15 wt. % nickel-chromium alloy.

9. A powder for use in a thermal spraying coating process, comprising particles consisting essentially of a nickel-chromium alloy containing a chromium carbide dissolved therein, wherein the particles have been formed by heating a mixture of fine starting particles of the carbide in the presence of the nickel-chromium alloy under conditions effective to cause from more than 90 wt. % to 100 wt. % of the starting carbide to dissolve therein, and wherein the relative amounts of the carbide and the nickel-chromium alloy are selected so that, upon cooling of a thermally sprayed coating made from the powder, substantially all of the carbide remains in solution in the nickel-chromium alloy.

10. The powder of claim 9 wherein the fine particles of starting chromium carbide have sizes in the range of from 1 to 10 microns.

11. The powder of claim 10, wherein the particles of the finished powder have particle sizes in the range of from about 2 to 44 microns, with an mean particle size of from about 9 to 13 microns.

12. The powder of claim 10, wherein the powder has been formed by the steps of:

blending particulate chromium carbide with a particulate nickel-chromium alloy to form a mixture;

sintering the mixture to form a solid mass;

grinding the solid mass; and classifying the ground solid mass to obtain the powder.

13. The powder of claim 12, wherein the mixture is sintered at a temperature effective to cause solid state diffusion of the chromium carbide into the nickel-chromium alloy during formation of the solid mass, which mass thereby becomes a eutectic having a higher melting point than the starting nickel-chromium alloy.

14. The powder of claim 10, wherein the amounts of starting chromium carbide and nickel-chromium alloy are in the range of from 92 to 85 wt. % $Cr_3C_2$ to 8 to 15 wt. % nickel-chromium alloy.

* * * * *